US009938593B2

(12) United States Patent
Fujiwara et al.

(10) Patent No.: US 9,938,593 B2
(45) **Date of Patent: *Apr. 10, 2018**

(54) BLAST FURNACE OPERATION METHOD

(71) Applicant: JFE STEEL CORPORATION, Chiyoda-ku, Tokyo (JP)

(72) Inventors: Daiki Fujiwara, Tokyo (JP); Akinori Murao, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 179 days.

This patent is subject to a terminal disclaimer.

(21) Appl. No.: 14/781,693

(22) PCT Filed: Mar. 27, 2014

(86) PCT No.: PCT/JP2014/058793

§ 371 (c)(1),
(2) Date: Oct. 1, 2015

(87) PCT Pub. No.: WO2014/162964

PCT Pub. Date: Oct. 9, 2014

(65) Prior Publication Data

US 2016/0053338 A1 Feb. 25, 2016

(30) Foreign Application Priority Data

Apr. 3, 2013 (JP) ..... 2013-077524

(51) Int. Cl.
*F27B 1/16* (2006.01)
*C21B 7/16* (2006.01)
(Continued)

(52) U.S. Cl.
CPC ..... *C21B 5/003* (2013.01); *C21B 5/001* (2013.01); *C21B 7/163* (2013.01); *F27B 1/16* (2013.01);
(Continued)

(58) Field of Classification Search
CPC ..... C21B 5/001; C21B 5/003; C21B 7/163; F27D 2003/169; F27D 3/16; F27M 2001/04; F27B 1/16
(Continued)

(56) References Cited

U.S. PATENT DOCUMENTS 4,243,211 A * 1/1981 Leroy ..... C21C 5/48 266/268
6,319,458 B1 11/2001 Jung et al.
(Continued)

FOREIGN PATENT DOCUMENTS

CN 1275168 11/2000
CN 200942372 9/2007
(Continued)

OTHER PUBLICATIONS

International Search Report for International Application No. PCT/JP2014/058793 dated Apr. 28, 2014.
(Continued)

*Primary Examiner* — Scott Kastler
*Assistant Examiner* — Michael Aboagye
(74) *Attorney, Agent, or Firm* — RatnerPrestia

(57) ABSTRACT

A method is provided for operating a blast furnace by blowing at least a solid reducing material and a combustible gas into the furnace through tuyeres with a lance inserted into a blowpipe, wherein a tube-bundle type lance obtained by bundling a plurality of blowing tubes is used and when only a solid reducing material or two kinds of a solid reducing material and a combustible gas or three kinds of a solid reducing material, a combustible gas and a gaseous reducing material is simultaneously blown into an inside of the blast furnace through a tube for blowing the solid reducing material, a tube for blowing the combustible gas and a tube for blowing the gaseous reducing material in the
(Continued)

tube-bundle type lance, two or more tube-bundle type lances are inserted into the blowpipe to approximate their front ends to each other and blowing is performed so that the respective blowout streams interfere with each other in the blowpipe.

11 Claims, 14 Drawing Sheets

(51) Int. Cl.
*C21B 5/00* (2006.01)
*F27D 3/16* (2006.01)

(52) U.S. Cl.
CPC ..... *F27D 3/16* (2013.01); *F27D 2003/169* (2013.01); *F27M 2001/04* (2013.01)

(58) Field of Classification Search
USPC ..... 266/47, 268
See application file for complete search history.

(56) References Cited

U.S. PATENT DOCUMENTS

| | | | | |
|---|---|---|---|---|
| 9,309,578 | B2 * | 4/2016 | Murao | C21B 7/163 |
| 9,410,218 | B2 * | 8/2016 | Murao | C21B 5/003 |
| 2011/0101576 | A1 | 5/2011 | Cho et al. | |
| 2015/0184263 | A1 | 7/2015 | Murao | |
| 2016/0040261 | A1 * | 2/2016 | Fujiwara | C21B 5/001 266/47 |

FOREIGN PATENT DOCUMENTS

| | | | |
|---|---|---|---|
| CN | 102485913 | | 6/2012 |
| EP | 2653565 | A1 | 10/2013 |
| JP | 01092304 | | 4/1989 |
| JP | 0338344 | | 4/1991 |
| JP | H03038344 | U | 4/1991 |
| JP | 05125412 | | 5/1993 |
| JP | H05125412 | A | 5/1993 |
| JP | 1112613 | | 1/1999 |
| JP | 2001200308 | | 7/2001 |
| JP | 2003096510 | | 4/2003 |
| JP | 2003096510 | A | 4/2003 |
| JP | 2003286511 | A | 10/2003 |
| JP | 2004183104 | | 7/2004 |
| JP | 2007162038 | | 6/2007 |
| JP | 2010537153 | | 12/2010 |
| JP | 2011174171 | | 9/2011 |
| JP | 2011174171 | A | 9/2011 |
| KR | 20010010274 | | 2/2001 |
| RU | 2245373 | C1 | 1/2005 |
| SU | 994561 | A2 | 2/1983 |
| WO | 0009763 | | 2/2000 |
| WO | 0028097 | A1 | 5/2000 |
| WO | 2009028909 | A2 | 3/2009 |
| WO | 2012098714 | A1 | 7/2012 |
| WO | 2014010660 | | 1/2014 |

OTHER PUBLICATIONS

Extended European Search Report dated Feb. 22, 2016 in European Application No. 14778846.7-1373.
Australian Examination Report for Australian Application No. 2014-250567 dated Apr. 8, 2016.
Chinese Office Action dated Aug. 19, 2016 for Chinese Application No. 2014800191702, including Concise Statement of Relevance, 8 pages.
Canadian Office Action for Application No. 2903955, dated Mar. 7, 2017, 3 pages.
Russian Office Action for Russian Application No. 2015147176, dated Feb. 22, 2017, including English translation, 10 pages.
Non Final Office Action for U.S. Appl. No. 14/781,698, dated Jun. 7, 2017, 10 pages.
Non Final Office Action for U.S, Appl. No. 14/412,340, dated Sep. 15, 2015, 9 pages.
Korean Office Action for Applicaton No. 10-2015-7022519, dated Jun. 21, 2016, with an English language Concise Statement of Relevance of Office Action, 6 pages.

* cited by examiner (a)

| | Nominal diameter | Nominal thickness | Outer diameter mm | Inner diameter mm | Gauge mm |
|---|---|---|---|---|---|
| Outer tube | 20A | Schedule 10S | 27.20 | 23.00 | 2.1 |
| Middle tube | 15A | Schedule 40 | 21.70 | 16.10 | 2.8 |
| Inner tube | 8A | Schedule 10S | 13.80 | 10.50 | 1.65 |

(b)

| | Nominal diameter | Nominal thickness | Outer diameter mm | Inner diameter mm | Gauge mm |
|---|---|---|---|---|---|
| First tube 21 | 8A | Schedule 5S | 13.80 | 10.50 | 1.65 |
| Second tube 22 | 6A | Schedule 10S | 10.50 | 8.10 | 1.20 |
| Third tube 23 | 6A | Schedule 20S | 10.50 | 7.50 | 1.50 |

(a)

(b)

BLAST FURNACE OPERATION METHOD

CROSS-REFERENCE TO RELATED APPLICATIONS

This is the U.S. National Phase application of PCT International Application No. PCT/JP2014/058793, filed Mar. 27, 2014, and claims priority to Japanese Patent Application No. 2013-077524, filed Apr. 3, 2013, the disclosures of each of these applications being incorporated herein by reference in their entireties for all purposes.

FIELD OF THE INVENTION

This invention relates to a method of operating a blast furnace by blowing a solid reducing material such as pulverized coal or the like and a flammable gaseous reducing material such as LNG or the like together with a combustible gas into the blast furnace through tuyeres thereof.

BACKGROUND OF THE INVENTION

Recently, global warming is pointed out associated with the increase of carbon dioxide emission, which is a significant issue even in the iron industry. As to such an issue, an operation with a low reduction agent ratio (total amount of a reducing material blown through tuyeres and coke charged from a top of the furnace per 1 ton of pig iron to be produced) is driven forward in recent blast furnaces. In the blast furnace, coke and pulverized coal are mainly used as a reducing material. Therefore, in order to attain the operation with a low reduction agent ratio and hence the suppression of carbon dioxide emission, it is effective to replace coke or the like with a reducing material having a high hydrogen content ratio such as waste plastic, LNG, heavy oil or the like.

Patent Document 1 discloses a method wherein the reduction agent ratio is decreased by using a plurality of lances and blowing a solid reducing material, a gaseous reducing material and a combustible gas through the respective lances to promote the heating of the solid reducing material to thereby improve the combustion efficiency and hence suppress the generation of unburned powder or coke breeze for improving air permeability. Patent Document 2 discloses a technique wherein coaxially multiple-tube type lances are used and a combustible gas is blown through an inner tube and a gaseous reducing material and a solid reducing material are blown from a gap between inner tube and outer tube. Patent Document 3 proposes a lance wherein plural small-size tubes are arranged in parallel around a main lance tube. Patent Document 4 discloses multiple nozzles in which plural blowing tubes are arranged in parallel at interval outside a fuel feeding tube when a combustible gas and a fuel are blown into a smelting reduction furnace, whereby a mixed state of the combustible gas and the fuel can be always maintained even if one of the nozzles is wear-damaged.

PATENT DOCUMENTS

Patent Document 1: JP-A-2007-162038
Patent Document 2: JP-A-2011-174171
Patent Document 3: JP-A-H11-12613
Patent Document 4: JP-U-H03-38344

SUMMARY OF THE INVENTION

The blast furnace operation method disclosed in Patent Document 1 has an effect of increasing a combustion temperature and reducing a specific consumption of a reducing material as compared to a method of blowing only a solid reducing material (pulverized coal) through tuyeres in a point of also blowing a gaseous reducing material, but the effect is still insufficient. Also, the multiple-tube type lance disclosed in Patent Document 2 requires the cooling of the lance, so that the outer blowing rate should be made faster. To this end, a gap between the inner tube and the outer tube should be made narrow, and hence the predetermined gas amount cannot be flown and there is a risk of not obtaining a required combustibility. On the other hand, in order to establish the gas amount and the flow rate, the lance diameter should be made large, which brings about the decrease of blast volume fed from a blowpipe. As a result, a risk of breaking the surrounding refractories is increased in association with the decrease of amount of molten iron tapped or the increase of plug-in diameter for the lance.

In the technique disclosed in Patent Document 3 is used a lance formed by arranging the plural small-size tubes around the main tube, so that there are problems that not only a risk of clogging the small-size tubes due to the decrease of the cooling ability is enhanced but also the process cost of a lance becomes higher. Also, this technique has a problem that pressure loss and the diameter become larger because the multiple tubes are changed into parallel tubes on the way.

As previously mentioned, hot air is supplied to the blast furnace from the tuyeres thereof, but the solid reducing material and the combustible gas are also blown into the furnace with this hot air. In the lance disclosed in Patent Document 4, the solid reducing material and the combustible gas are blown with the coaxially double-tubed lance, but a single tube lance blowing the gaseous reducing material is further arranged in parallel to the double-pipe lance. In such a lance, the occupying area of the lance to the sectional area of the blast pipe and tuyere is large to bring about the increase of running cost associated with the increase of blast pressure or the decrease of visual field in a furnace-monitoring window disposed in a back face of the tuyere. Furthermore, a size of a portion for inserting the lance into the blowpipe (guide tube) is made large to decrease an adhesion area between the guide tube portion and the blowpipe, and hence there is a problem that peeling of the guide tube portion is apt to be easily caused.

It is an object of the invention to propose a blast furnace operation method effective for attaining the improvement of the productivity and the decrease of specific consumption of a reducing material by simultaneously establishing the increase of cooling ability and the improvement of combustibility without increasing the outer diameter of the lance as well as the structure of the lance used in the operation of this method.

The blast furnace operation method according to aspects of the invention developed for achieving the above object includes a method of operating a blast furnace by blowing at least a solid reducing material and a combustible gas into the furnace through tuyeres with a lance inserted into a blowpipe, wherein a tube-bundle type lance obtained by bundling a plurality of blowing tubes is used and when only a solid reducing material or two kinds of a solid reducing material and a combustible gas or three kinds of a solid reducing material, a combustible gas and a gaseous reducing material is simultaneously blown into an inside of the blast furnace through a tube for blowing the solid reducing material, a tube for blowing the combustible gas and a tube for blowing the gaseous reducing material in the tube-bundle type lance, two or more tube-bundle type lances are inserted into the blowpipe to approximate their front ends to each other and blowing is performed so that the respective blowout streams interfere with each other in the blowpipe.

In the invention are provided the following features as a preferable means:

(1) the tube-bundle type lance is constructed by bundling three parallel blowing tubes and housing them into an outer tube of the lance;

(2) the tube-bundle type lance is constructed by passing a tube for blowing the solid reducing material through a central portion of the lance and alternately winding both of a spiral tube for blowing the combustible gas and a spiral tube for blowing the gaseous reducing material around the solid reducing material blowing tube to integrally unite them;

(3) when at least solid reducing material and combustible gas are simultaneously blown through the respective tubes of the two tube-bundle type lances, a blowing stream of the solid reducing material is flown outside a blowing stream of the combustible gas passing through a central portion of the blowpipe;

(4) when at least solid reducing material and combustible gas are simultaneously blown through the respective lances of the two tube-bundle type lances, blowing is performed by arranging the lances so that two blowing streams of the solid reducing material blown from the respective tube-bundle type lances do not collide with each other, while the blowing streams of the solid reducing material collide with a blowing stream of the combustible gas;

(5) when at least solid reducing material and combustible gas are simultaneously blown through the respective lances of the two tube-bundle type lances, the blowing streams of the solid reducing material blown from the respective tube-bundle type lances do not collide with each other, while they converge and collide with blowing streams of the combustible gas blown from the respective tube-bundle type lances to thereby separate the two blowing streams of the solid reducing material;

(6) when at least solid reducing material and combustible gas are simultaneously blown through the respective lances of the two tube-bundle type lances, blowing streams of the solid reducing material blown from the respective tube-bundle type lances collide with each other, while blowing streams of the gaseous reducing material and the combustible gas not converging nor colliding with the blowing stream of the solid reducing material are blown so as to introduce into the outside of the blowing stream of the solid reducing material in the central portion of the blowpipe.

According to the blast furnace operation method of an embodiment of the invention, when the solid reducing material and either one or both of the gaseous reducing material and the combustible gas are simultaneously blown into the blast furnace from the tuyeres through a lance inserted into the blowpipe, two or more tube-bundle type lances are used, whereby a diameter of each of the blowing tubes itself can be maintained at a large scale without increasing the outer diameter of the lance, so that it can be attained to establish the increase of cooling ability and the improvement of the combustibility, and hence the specific consumption of the reducing material can be decreased.

In the invention, the tube-bundle type lance is preferably used by alternately winding spiral blowing tube for the combustible gas and spiral blowing tube for the gaseous reducing material around a blowing tube for the solid reducing material passing through the cylindrical central portion and integrally uniting them, whereby the blowing stream of the gaseous reducing material and the blowing stream of the combustible gas are flown in a state of revolving around the blowing stream of the solid reducing material, and hence the blowing can be performed while diffusing the solid reducing material to more further improve the combustion efficiency of the solid reducing material.

According to the invention, front ends of the two tube-bundle type lances inserted into the blowpipe are preferably approximated to each other and are converged so as to interfere their blowout directions with each other, for example, the lances are arranged so as to sandwich the combustible gas between the solid reducing materials and surround the outside thereof with the combustible gas, so that the combustion efficiency of the solid reducing material can be more improved.

Furthermore, according to the invention, the lances are preferably arranged so that the blowing streams of the solid reducing material do not collide with each other and the combustible gas collides with the blowing stream of the solid reducing material from the other lance, whereby the combustion efficiency of the solid reducing material is further improved.

DETAILED DESCRIPTION OF EMBODIMENTS OF THE INVENTION

Figure 1:
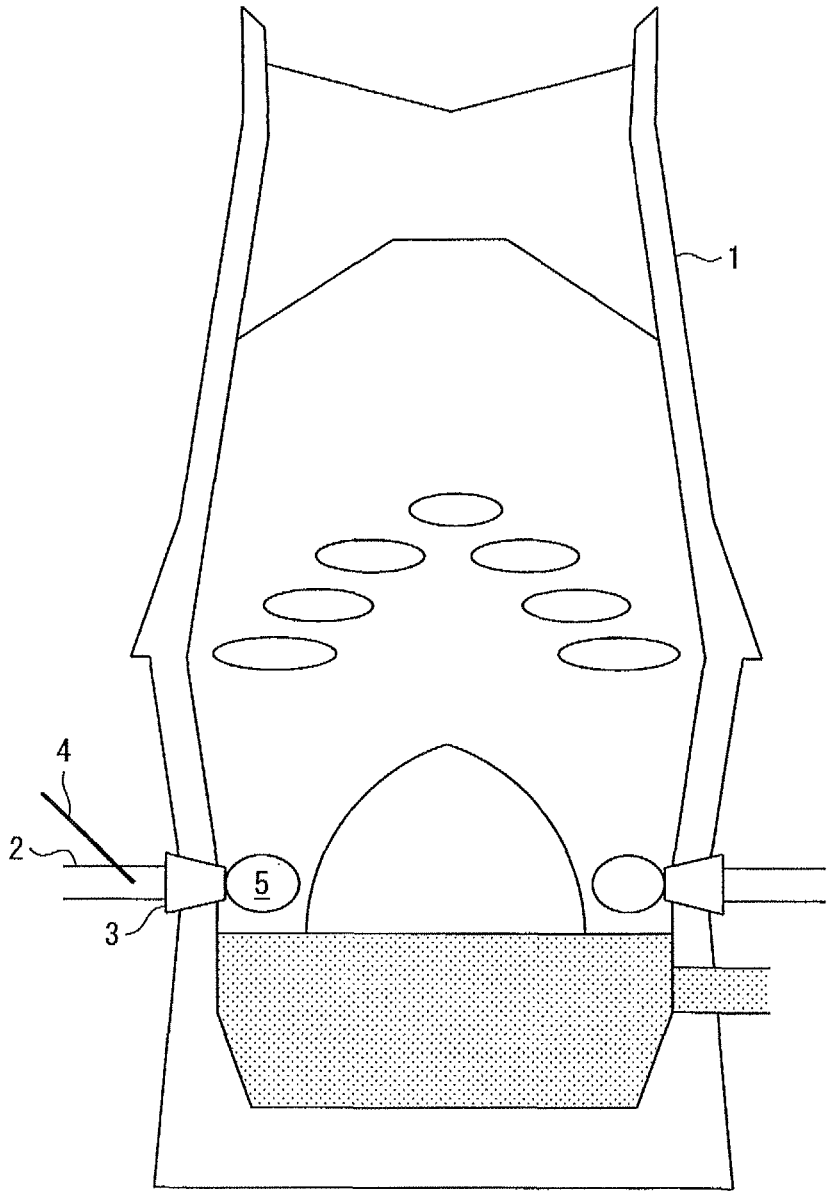
FIG. 1 is a schematically longitudinal section view showing an outline of a blast furnace.

A preferable embodiment of the blast furnace operation method according to the invention will be described below. FIG. 1 is an overall view of a blast furnace 1 used in the blast furnace operation method according to an embodiment of the invention. In the blast furnace 1 are arranged a plurality of tuyeres 3 in a peripheral direction of its bosh portion. A blowpipe 2 for blowing hot air is connected to the tuyere 3, and a lance 4 for blowing a solid fuel, a combustible gas or the like is inserted into the blowpipe 2 toward the tuyere 3. In the furnace forward a blowout direction of hot air from the tuyere 3 is formed a combustion space called as a raceway 5 being also a clumpy coke deposit layer charged from a top of the furnace. A molten iron is mainly produced in the combustion space.

Figure 2:
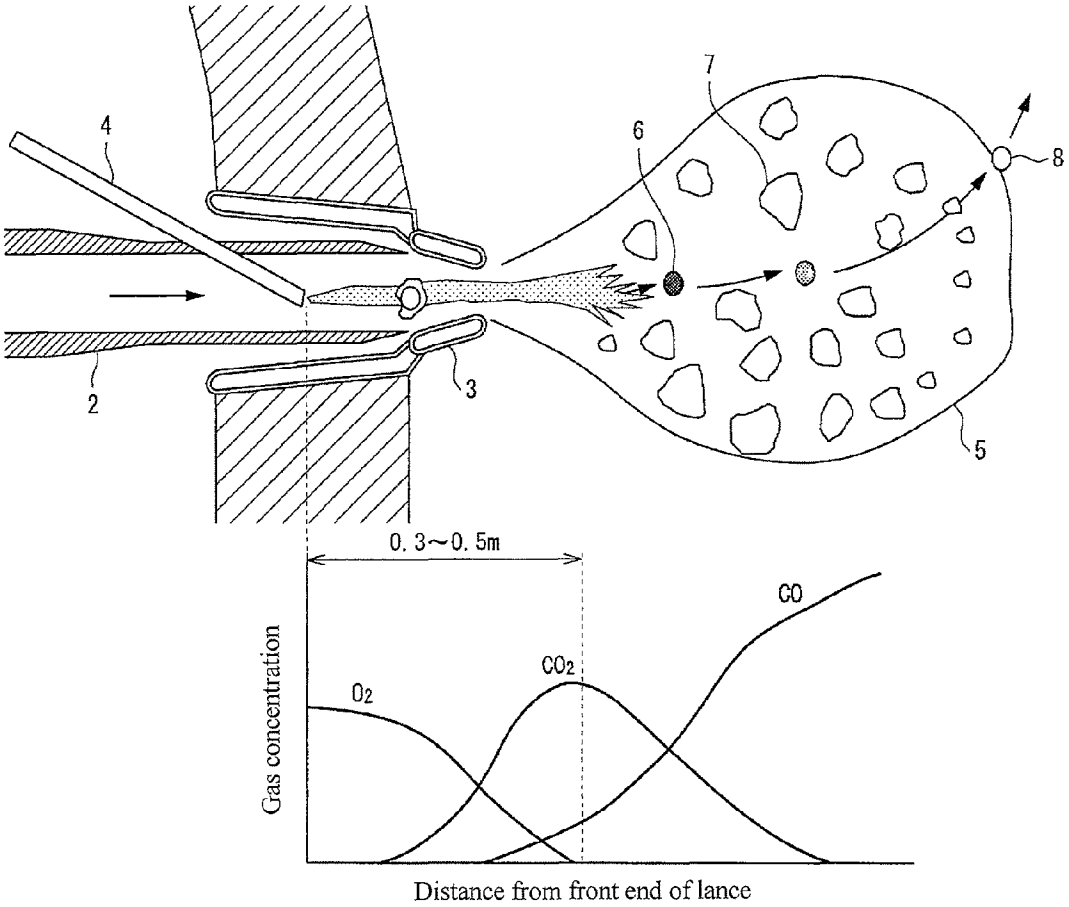
FIG. 2 is an explanatory diagram of a combustion state when only pulverized coal is blown into a blast furnace through a lance.

FIG. 2 is a view schematically illustrating a combustion state when only a solid reducing material (which will be described in the following example of "Pulverized coal 6") is blown from the lance 4 through the tuyere 3 into the furnace. As shown in this figure, volatile matter or fixed carbon of the pulverized coal 6 blown from the lance 4 through the tuyere 3 to the raceway 5 are combusted together with the deposited coke 7, while an aggregate of unburned residual carbon and ash or a char is discharged from the raceway 5 as an unburned char 8. Moreover, a blowing rate of hot air forward the tuyere 3 in a blowout direction of the hot air is about 200 m/sec. On the other hand, a distance arriving from the front end of the lance 4 to the raceway 5 or an $O_2$ existing region is about 0.3-0.5 m. Therefore, the heating of pulverized coal particles blown or the contacting of the pulverized coal with $O_2$ (dispersibility) is necessary to be substantially performed in a short time of 1/1000 second.

Figure 3:
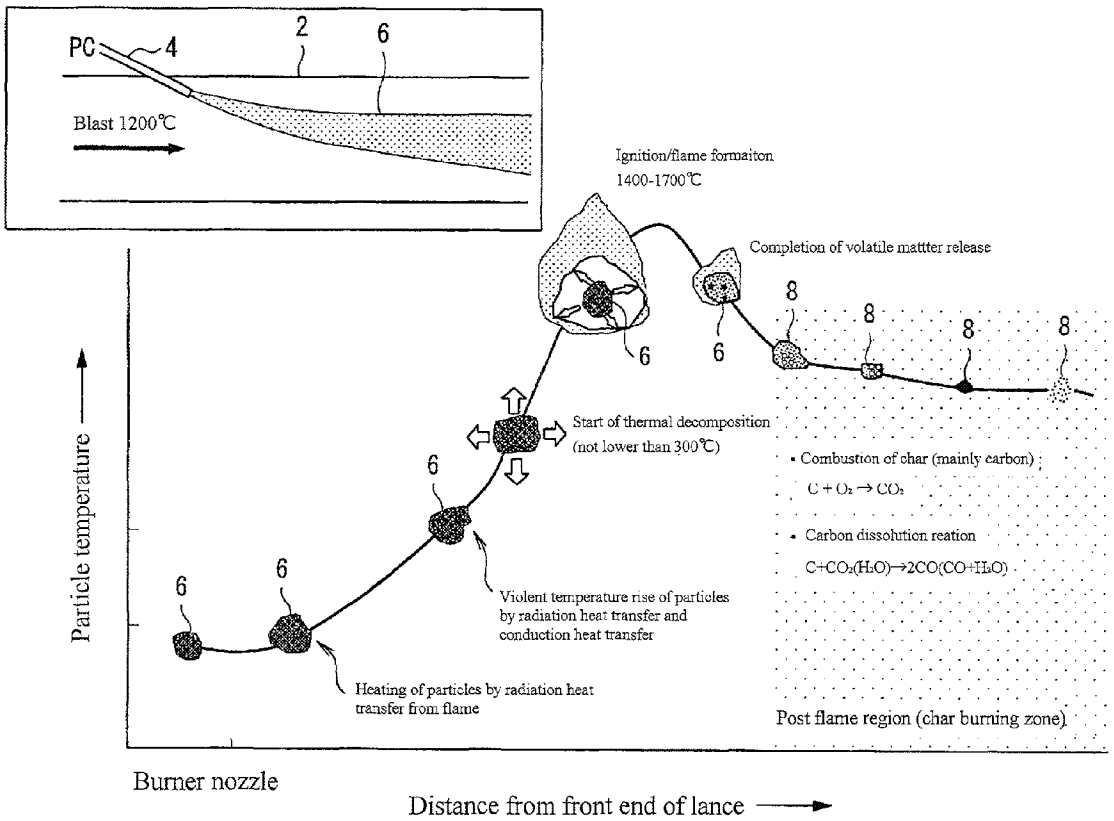
FIG. 3 is an explanatory diagram of a combustion mechanism in the blowing of only pulverized coal.

FIG. 3 shows a combustion mechanism when only the pulverized coal (PC) 6 is blown from the lance 4 into the blowpipe 2. The pulverized coal 6 blown from the tuyere 3 into the raceway 5 is heated by radiant heat transfer from the flame in the raceway 5 and further the temperature thereof is violently raised by radiant heat transfer and conduction transfer and thermal decomposition is started from a time of heating above 300° C. and volatile matter is ignited and burned (flame formation) to arrive in a temperature of 1400-1700° C. The pulverized coal after the discharge of volatile matter is the unburned char 8. Since the char 8 is composed mainly of fixed carbon, carbon dissolving reaction is caused together with the combustion reaction.

Figure 4:
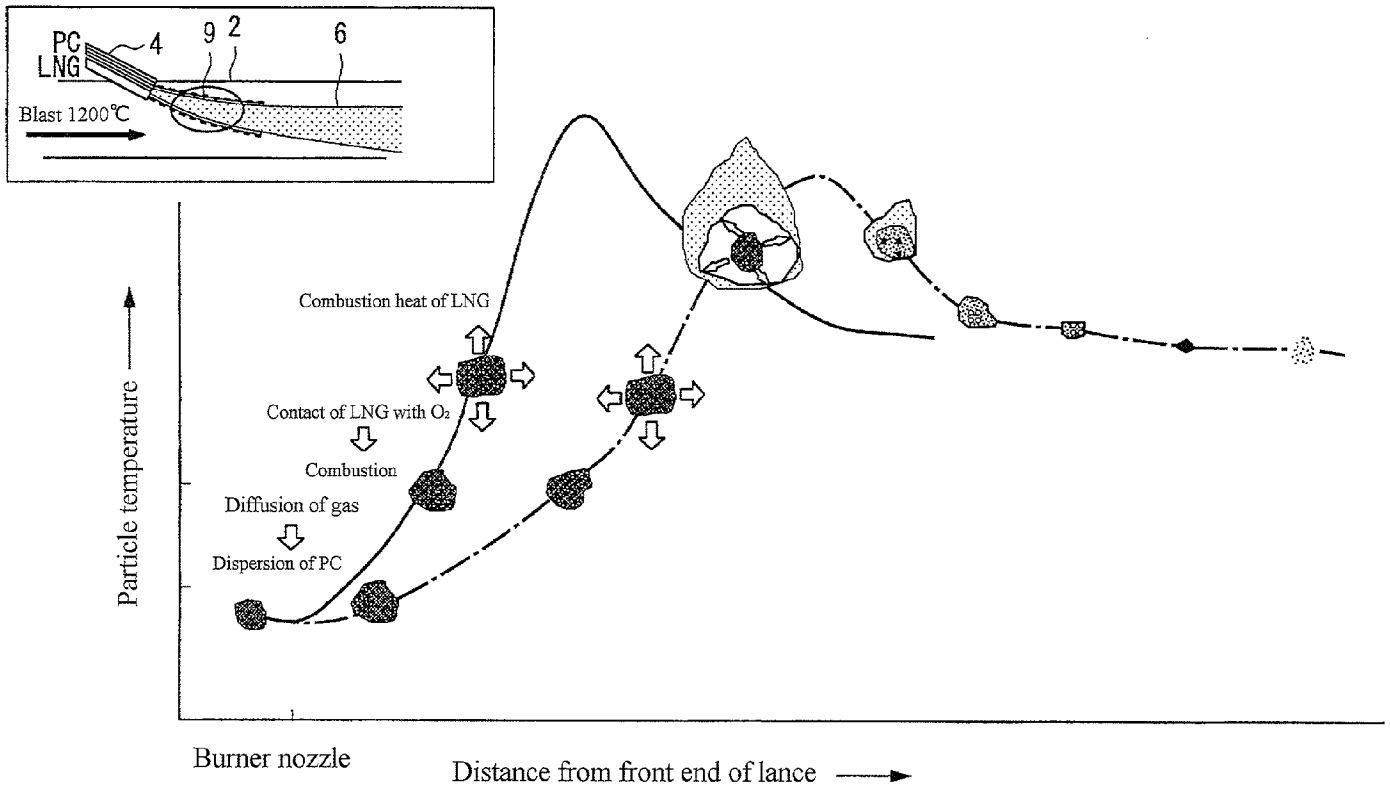
FIG. 4 is an explanatory diagram of a combustion mechanism in the blowing of pulverized coal, LNG and oxygen.

FIG. 4 shows a combustion mechanism when LNG 9 and oxygen (oxygen is not shown) are blown together with the pulverized coal 6 from the lance 4 into the blowing pipe 2. The simultaneous blowing of the pulverized coal 6, LNG 9 and oxygen is simply shown as a case of blowing in parallel. Moreover, a two-dot chain line in this figure shows a combustion temperature in the blowing of only the pulverized coal shown in FIG. 3. When the pulverized coal, LNG and oxygen are simultaneously blown as mentioned above, the pulverized coal is dispersed associated with the diffusion of gas, and LNG is combusted by the contacting of LNG with oxygen ($O_2$), and the pulverized coal is considered to be rapidly heated by the combustion heat, whereby the pulverized coal is combusted in a position near to the lance.

Figure 5:
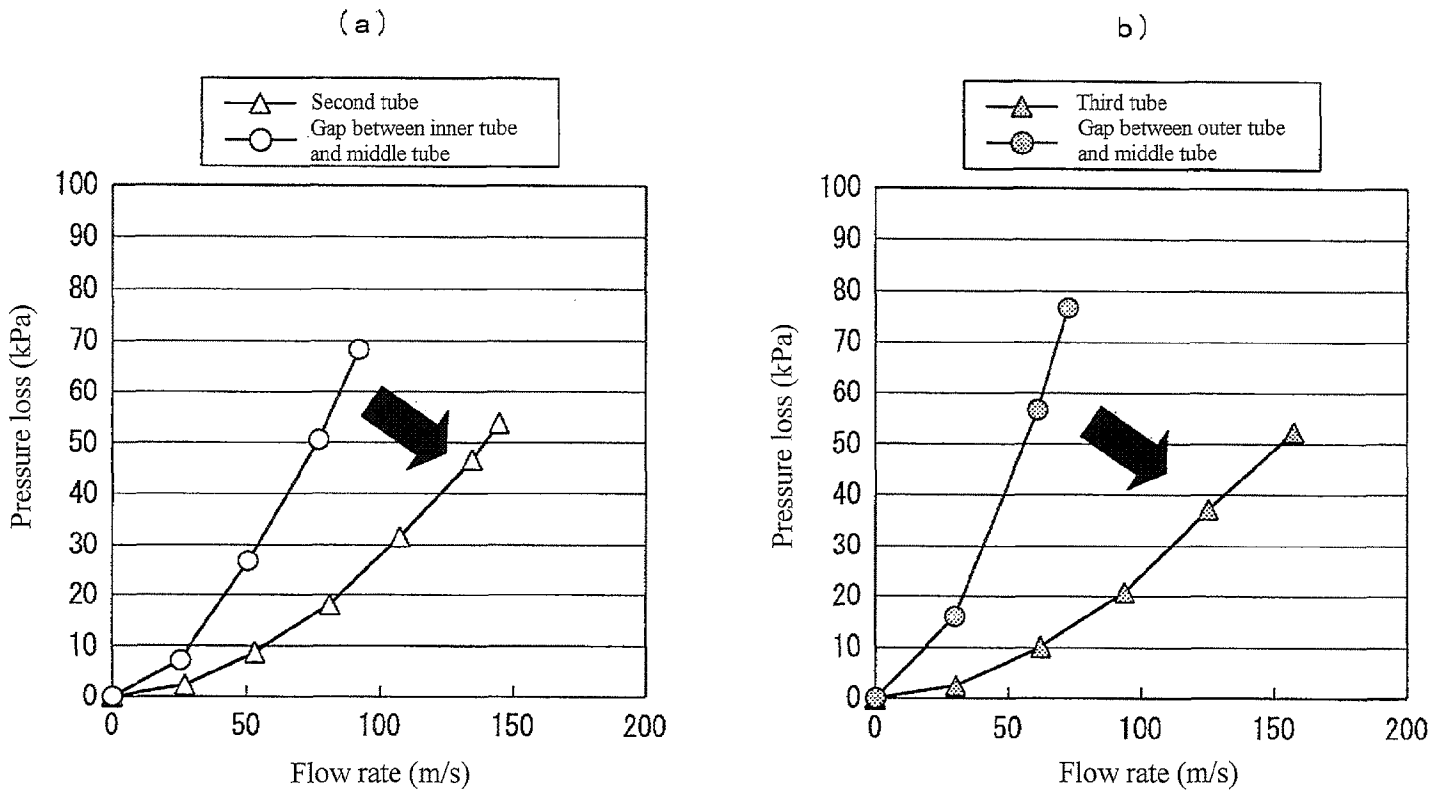
FIG. 5 is a comparative graph of pressure loss in a multiple-tube type lance and a tube-bundle type lance.

FIG. 5 is a view of pressure loss between the conventionally used multiple-tube type lance and the tube-bundle type lance that can be used in the invention. As seen from this figure, the pressure loss in the same sectional area is low in the tube-bundle type lance as compared with the multiple-tube type lance. This difference is considered due to the fact that the respective blowing paths (areas in tubes) are made larger to reduce airflow resistance in the tube-bundle type lance as compared to the conventional lance.

Figure 6:
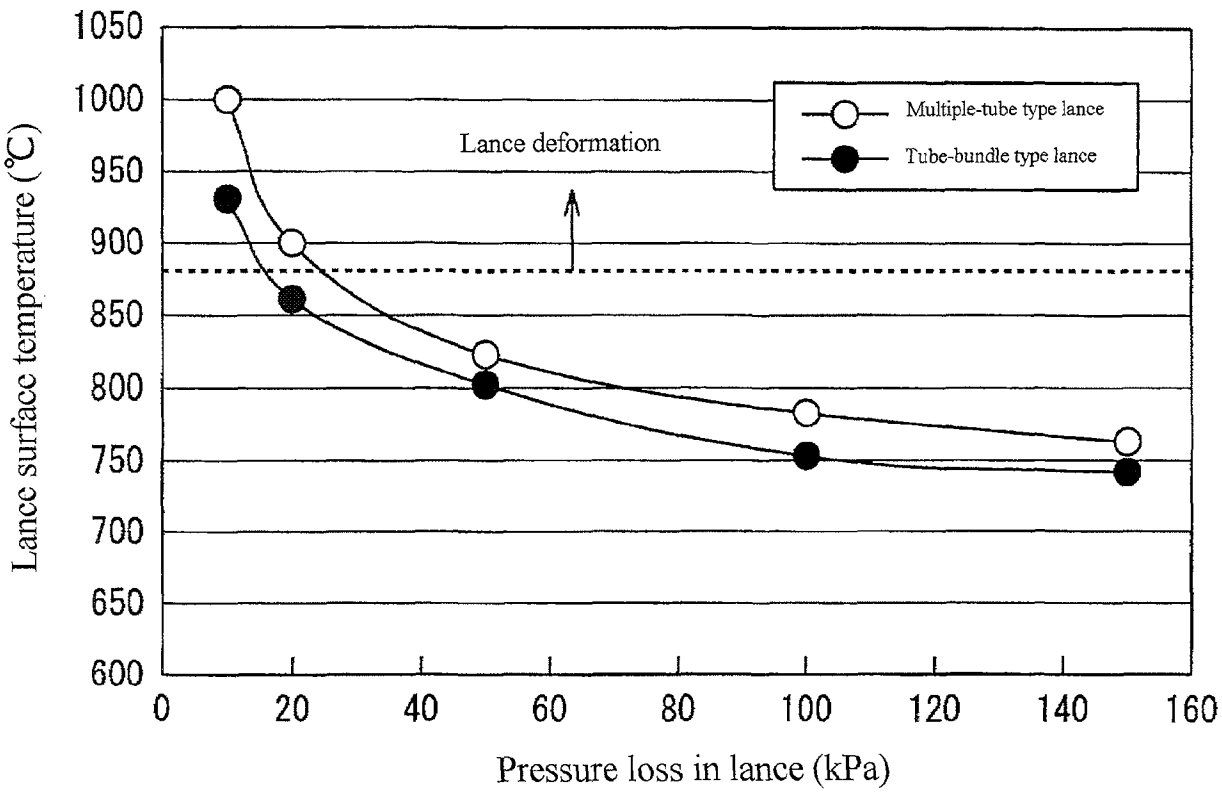
FIG. 6 is a graph showing a lance surface temperature in combustion experiment.

FIG. 6 shows comparative results of cooling ability between the multiple-tube type lance and the tube-bundle type lance. As seen from this figure, the tube-bundle type lance is high in the cooling ability under the same pressure loss as compared to the multiple-tube type lance. This is considered due to the fact that the flow rate capable of flowing under the same pressure loss is high because the airflow resistance is low.

Figure 7:
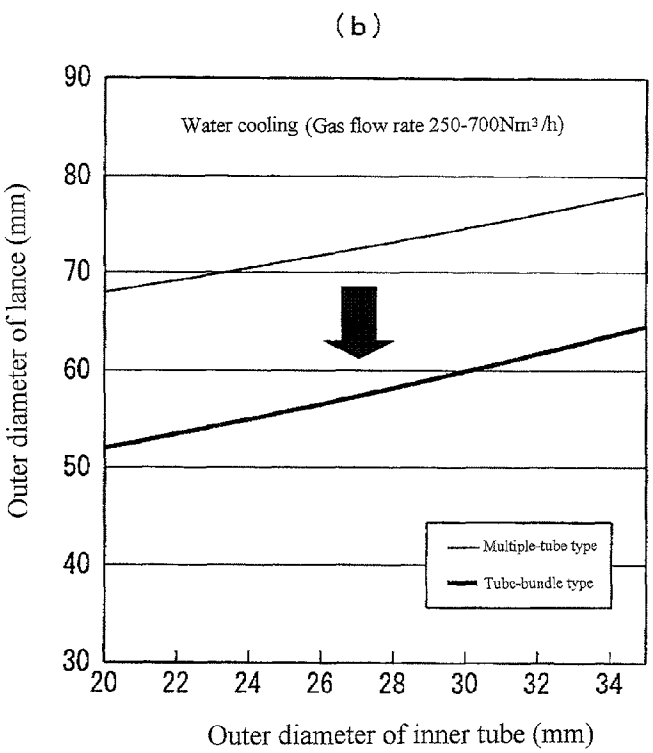
FIG. 7 is a graph showing a relation between outer diameter of an inner tube in a lance and outer diameter of a lance.

FIG. 7 shows a relation between an outer diameter of an inner tube in the lance and an outer diameter of the lance. FIG. 7*a* is an outer diameter of non-water cooling type lance and FIG. 7*b* is an outer diameter of a water cooling type lance. As seen from this figure, the tube-bundle type lance becomes small in the outer diameter of the lance as compared to the multiple-tube type lance. This is considered due to the fact that the flow path, tube thickness and sectional area of the water cooling portion can be decreased in the tube-bundle type lance as compared to the multiple-tube type lance.

Figure 8:
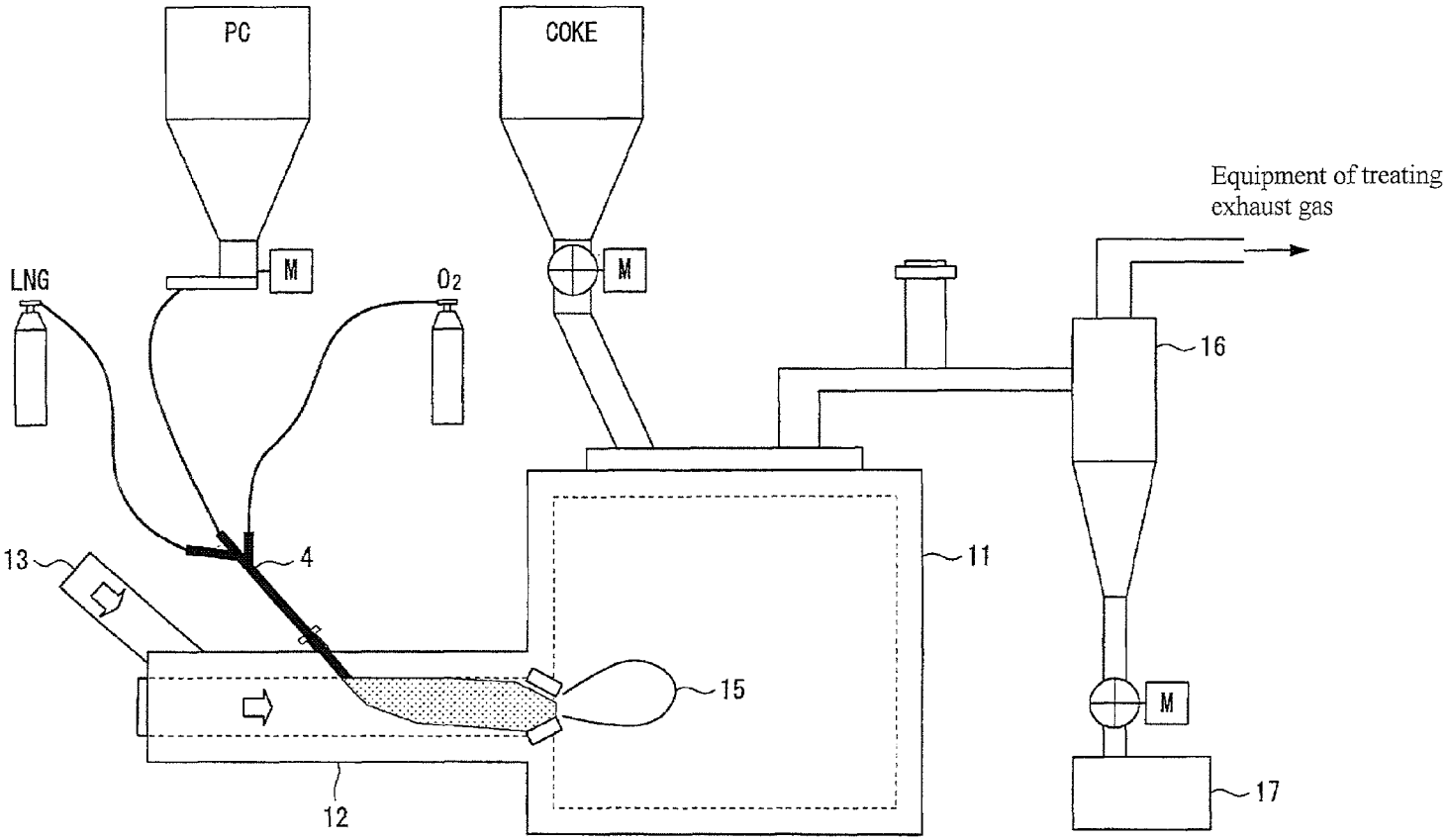
FIG. 8 is a schematic view of an apparatus for combustion experiment.

In order to compare the combustibility between the multiple-tube type lance and the tube-bundle type lance, combustion experiment is performed with a combustion experiment device shown in FIG. 8. An experimental furnace 11 used in the experiment device is filled with coke in which an interior of a raceway 15 can be observed through an inspection window. In this experiment device is attached a blowpipe 12, through which hot air produced by an outside combustion burner 13 can be blown into the experimental furnace 11. Also, a lance 4 is inserted into the blowpipe 12. In the blowpipe 12, it is possible to enrich oxygen in the blast. Moreover, the lance 4 can blow pulverized coal and either one or more of LNG and oxygen through the blowpipe 12 into the experimental furnace 11. On the other hand, exhaust gas generated in the experimental furnace 11 is separated into exhaust gas and dust in a separation device 16 called as a cyclone. The exhaust gas is supplied to an equipment of treating exhaust gas such as an auxiliary combustion furnace or the like, while the dust is collected in a collection box 17.

In this combustion experiment, a single tube lance, a coaxially multiple tube lance (multiple-tube type lance) and a tube-bundle type lance prepared by bundling plural blowing tubes (preferably 2-3 tubes) at a parallel state and housing them in an outer tube along its axial direction are used as the lance 4. Then, the combustion rate, pressure loss in lance, lance surface temperature and outer diameter of lance are measured as to (1) a case that only the pulverized coal is blown through the single tube lance, (2) a case that the pulverized coal is blown from an inner tube of the conventional multiple-tube type lance, and oxygen is blown from a gap between the inner tube and the middle tube and LNG is blown from a gap between the middle tube and the outer tube, and (3) a case that pulverized coal and one or more of LNG and oxygen are blown through the respective blowing tubes of the tube-bundle type lance. The combustion rate is measured by changing a blowing rate of oxygen. The combustion rate is determined from an unburned amount of an unburned char recovered from behind the raceway with a probe.

Figure 9:
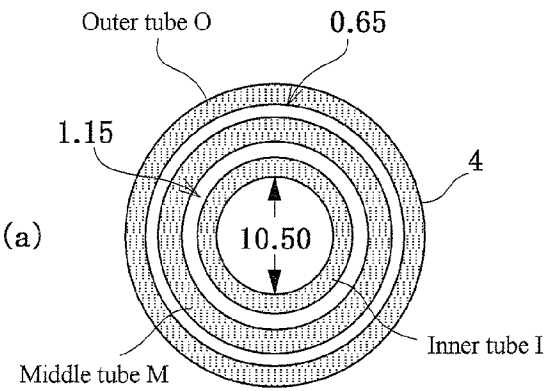
FIG. 9 is an explanatory diagram of blowing tubes in a lance.
Figure 9:
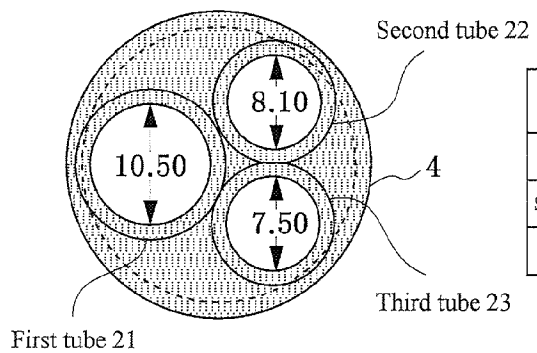

FIG. 9(*a*) shows an example of the conventional multiple-tube type lance, and FIG. 9(*b*) shows an example of the tube-bundle type lance used in the invention. In the multiple-tube type lance, a stainless steel pipe having a nominal diameter of 8 A and a nominal thickness schedule of 10 S is used as an inner tube I, and a stainless steel pipe having a nominal diameter of 15 A and a nominal thickness schedule of 40 is used as a middle tube M, and a stainless steel pipe having a nominal diameter of 20 A and a nominal thickness schedule of 10 S is used as an outer tube O. The dimensions of each of the stainless steel pipes are shown in the figure, wherein a gap between the inner tube I and the middle tube M is 1.15 mm and a gap between the middle tube M and the outer tube O is 0.65 mm.

In the tube-bundle type lance of FIG. 9(*b*), a stainless steel pipe having a nominal diameter of 8 A and a nominal thickness schedule of 5 S is used as a first tube 21, and a stainless steel pipe having a nominal diameter of 6 A and a nominal thickness schedule of 10 S is used as a second tube 22 and a stainless steel pipe having a nominal diameter of 6 A and a nominal thickness schedule of 20 S is used as a third tube 23, and these tubes are bundled at a parallel state and integrally housed in an outer tube of the lance.

Figure 10:
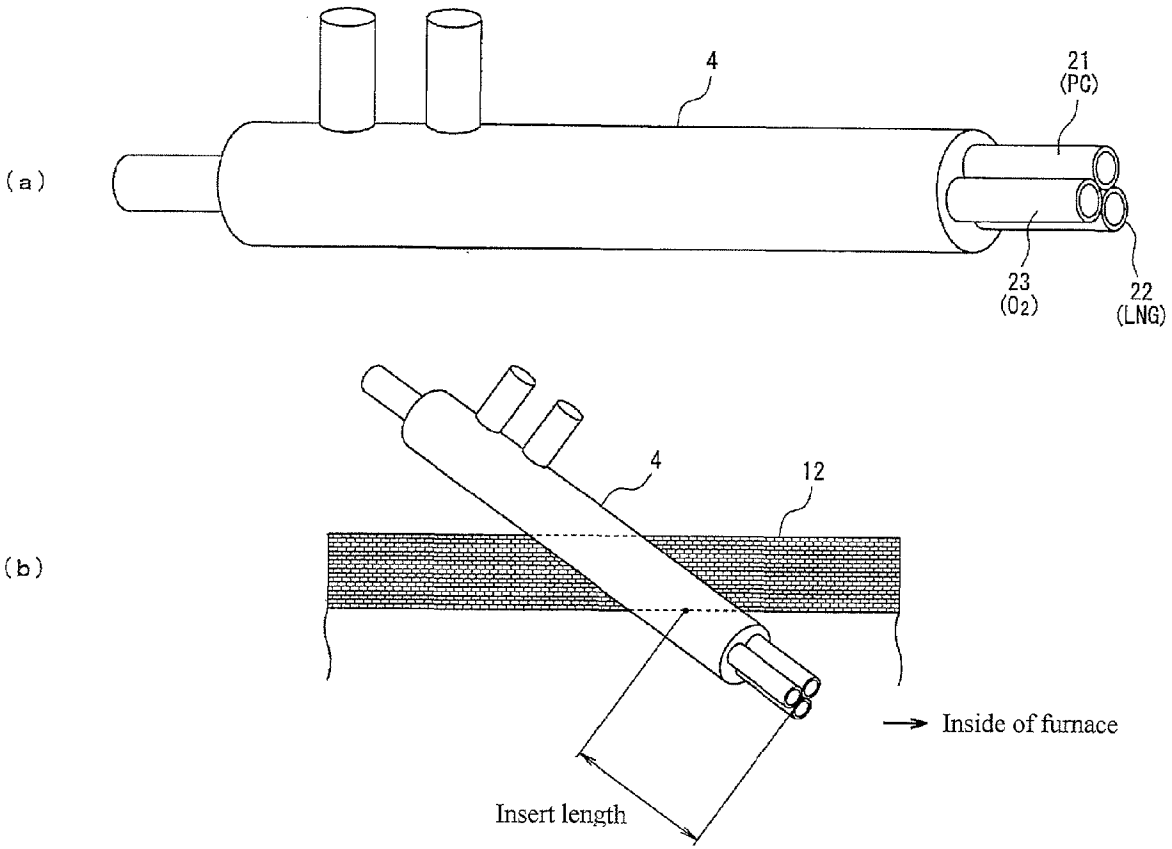
FIG. 10 is a view illustrating an appearance of a lance and an example of inserting into a blowpipe.
Figure 11:
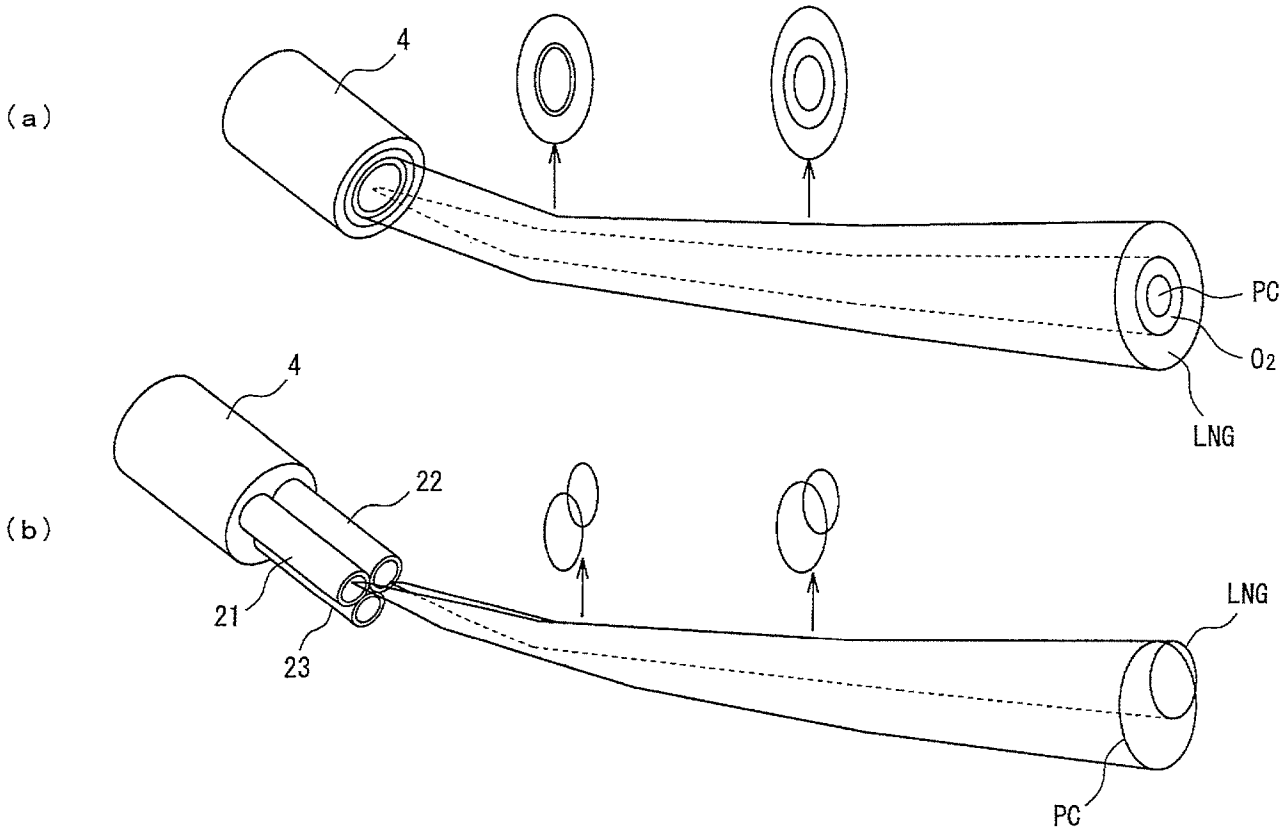
FIG. 11 is a view illustrating an example of a blowing state from a lance.

In the experiment, pulverized coal (PC) is blown through the tube 21 and LNG is blown through the tube 22 and oxygen is blown through the tube 23 in the tube-bundle type lance prepared by bundling three blowing tubes at a parallel state and housing in the outer tube of the lance 4 as shown in FIG. 10(*a*). Moreover, an insert length (insert depth) of the tube-bundle type lance into the blowpipe 12 is 200 mm as shown in FIG. 10(*b*). Also, a flow rate of oxygen is 10-200 m/s. The lance is disposed by obliquely inserting the front end toward the tuyere of the blast furnace (inside of furnace) or inserting the front ends of the two tube-bundle type lances 4 into the blowpipe 12 (without shooting out) as mentioned later and approximating their front ends to each other and interfering the respective blowout streams with each other in the blowpipe. Furthermore, the adjustment of oxygen flow rate is performed, for example, by providing a diameter-reducing section in a front end of the oxygen blowing tube 23 as shown in FIG. 11 and variously changing an inner diameter of the diameter-reducing section.

When the blowing is performed with the tube-bundle type lances 4, the lances are arranged so that the blowing streams interfere with each other in the front ends of the lances and, for example, it is preferable that streams of LNG and oxygen are adjusted so as to converge and collide with the blowing stream of pulverized coal. In FIG. 11(*a*) is shown a state of blowing through the multiple-tube type lance 4, and an outline of a blowing state through the tube-bundle type lance is shown in FIG. 11(*b*). As seen from the construction of FIG. 9(*a*), the pulverized coal, oxygen and LNG are blown while maintaining the concentric state without colliding with each other in the conventional multiple-tube type lance as shown in FIG. 11(*a*). On the contrary, directions of the pulverized coal stream, oxygen stream and LNG stream are adjusted in the tube-bundle type lance, for example, by adjusting the directions (arrangement) of the respective blowing tubes, respectively. Preferably, as shown in FIG. 11(*b*), the tube-bundle type lance is arranged in consideration of the directions of the respective blowing tubes in the tube-bundle type lance so that the LNG stream and oxygen stream (the oxygen stream is not shown) collide with the pulverized coal stream.

As a structure of a front end of the each blowing tube can be used a structure of obliquely cutting the front end or a structure of bending the front end. When the front end of the blowing tube is cut out obliquely, the diffusion state of LNG or oxygen blown can be changed. Also, when the front end of the blowing tube is bent, the direction of LNG or oxygen stream blown can be changed.

Figure 12:
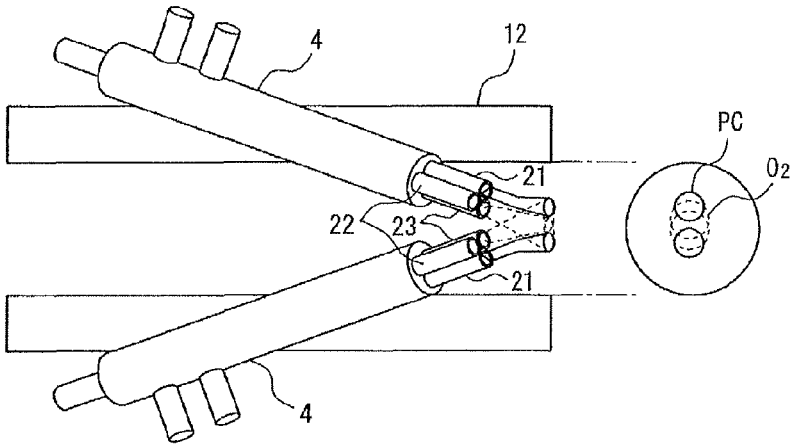
FIG. 12 is an explanatory diagram of a state blowing pulverized coal and oxygen.
Figure 12:
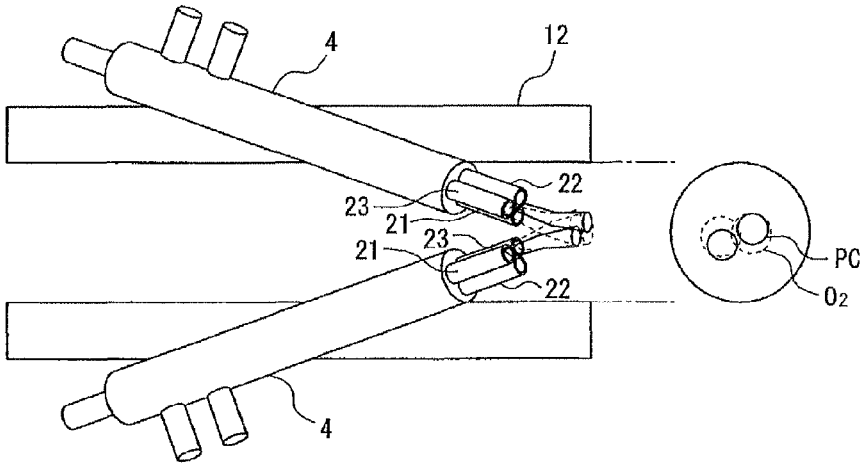

In a preferable embodiment of the invention, the tube-bundle type lances 4 to be inserted into the blowpipe 12 are arranged by approximating front ends of two or more lances to each other in the vicinity of axial center of the blowpipe so that the respective blowout directions converge and interfere with each other in the blowpipe 12 and at least the blowing stream of the solid reducing material and the blowing stream of the combustible gas interfere with each other at a constant relation. For example, as shown in FIG. 12, a pair of these lances are arranged by inserting them into the axial center of the blowpipe 12 from above and underneath so as to approximate the respective front ends to each other in the vicinity of the axial center.

In a more preferable embodiment of the invention, a pair of the two tube-bundle type lances are used, for example, by arranging the position of the oxygen blowing tube 23 so as to sandwich the oxygen stream blown with the pulverized coal stream (PC) as shown in FIG. 12*a* or so that the oxygen stream blown collides with the two pulverized coal streams blown through the separate lances as shown in FIG. 12*b*.

Figure 13:
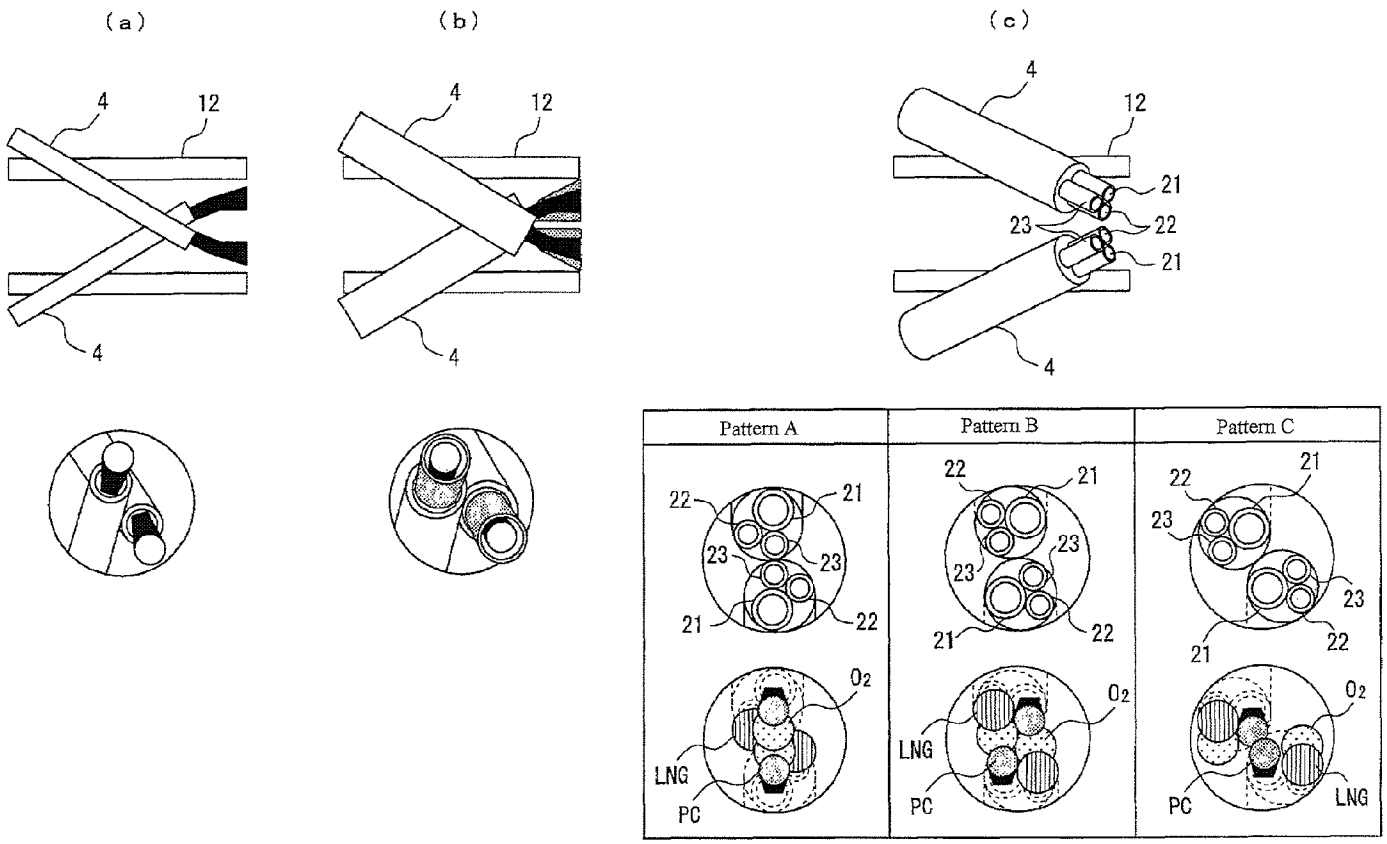
FIG. 13 is an explanatory diagram of a state blowing pulverized coal, LNG and oxygen in an experiment.

In this connection, for example, when the two single tube lances are used instead of the tube-bundle type lances, the lances should be arranged at an intersecting state so that the pulverized coal streams blown through the two single tube lances do not collide or mix with each other as shown in FIG. 13*a*. Also, when the two multiple-tube type lances are used, it is necessary that these lances are arranged so that the pulverized coal stream, the LNG stream and oxygen stream blown through the two multiple-tube type lances do not collide or mix with each other as shown in FIG. 13*b*.

However, when the two tube-bundle type lances are used, it is possible to arrange the lances so as to render into (a) a case that the oxygen stream blown is sandwiched between the two pulverized coal streams (Pattern A), (b) a case that the respective pulverized coal streams blown through the two tube-bundle type lances do not converge and collide with each other but converge and collide with the oxygen streams blown through the separate lances without being separated therewith (Pattern B) or (c) a case that the respective pulverized coal streams blown through the two tube-bundle type lances converge and collide with each other, while they converge and collide with the LNG streams and oxygen streams blown through the respective blowing tubes at a position not colliding therewith and flow outside the streams of the pulverized coals blown (Pattern C).

Then, combustion experiment is performed with respect to the examples shown in FIGS. 13*a-c*. Various items of the pulverized coal used in this experiment are a fixed carbon (FC) of 71.3%, a volatile matter (VM) of 19.6% and an ash content (Ash) of 9.1%, and the blowing condition thereof is 50.0 kg/h (corresponding to 158 kg/t as a specific consumption of pig iron). Also, the blowing condition of LNG is 3.6 kg/h (5.0 $Nm^3/h$, corresponding to 11 kg/t as a specific consumption of pig iron). The blast conditions are a blast temperature of 1100° C., a flow amount of 350 $Nm^3/h$, a flow rate of 80 m/s and $O_2$ enrichment+3.7 (oxygen concentration: 24.7%, enriched to 3.7% with respect to oxygen concentration in air of 21%).

Figure 14:
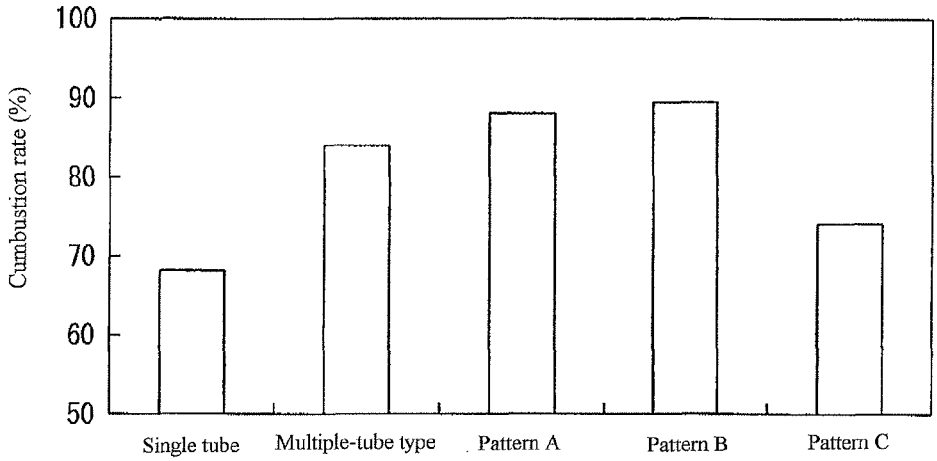
FIG. 14 is an explanatory diagram of combustion efficiency in results of combustion experiment.

FIG. 14 shows results of combustion rate measured on each example in the combustion experiment. As seem from this figure, when the oxygen stream blown is sandwiched between the pulverized coal streams blown in the tube-bundle type lance prepared by arranging three blowing tubes in parallel (Pattern A) and when the tube-bundle type lances are arranged so that the oxygen stream blown collides with the pulverized coal streams blown through the separate lances (Pattern B), the combustion rate becomes higher. Among them, when the lances are arranged so as to sandwich the oxygen stream blown with the pulverized coal streams (Pattern A), the diffusion of oxygen into blast (hot air) can be suppressed by sandwiching the oxygen stream with the pulverized coal streams. Moreover, when the lances are arranged so that the oxygen stream blown collides with the pulverized coal streams blown through the separate lances, it is considered that the mixing property between the pulverized coal stream and the oxygen stream is improved to promote the combustion. Further, the reason why the combustion rate is low when the pulverized coal streams blown collide with each other is considered due to the fact that the density of the pulverized coal after the collision of the pulverized coal streams becomes too high and the combustibility is thereby decreased.

Figure 15:
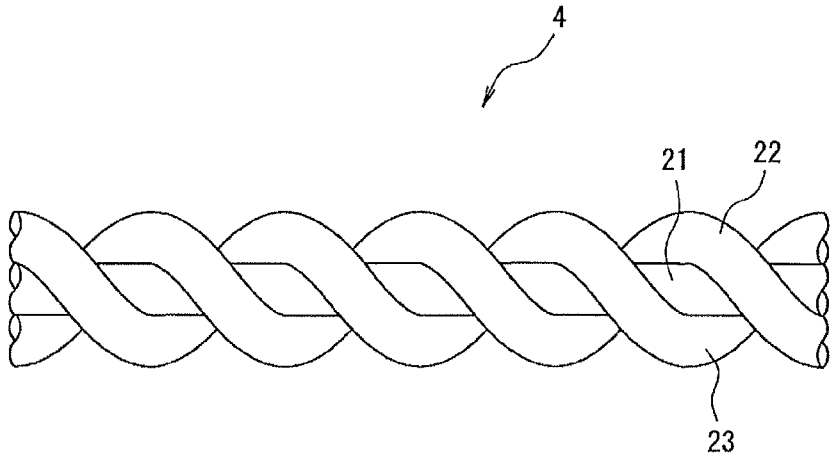
FIG. 15 is an explanatory diagram illustrating another example of blowing tubes in a lance.

As another example of the tube-bundle type lance 4 used in the invention may be used a lance, for example, prepared by alternately winding a spiral blowing tube for combustible gas and a spiral blowing tube for gaseous reducing material to a cylindrical blowing tube for solid reducing material passing through a central portion and integrally uniting them as shown in FIG. 15. By using such a lance 4 is flown LNG blowing stream and oxygen blowing stream in a state of revolving around the pulverized coal blowing stream, whereby the pulverized coal can be diffusely blown to further improve the combustion rate of the pulverized coal.

In the blast furnace operation method using the above tube-bundle type lance according to aspects of the invention, the pulverized coal (solid reducing material), LNG (gaseous reducing material) and oxygen (combustible gas) are blown into the tuyeres with the plural tube-bundle type lances 4 so that their blowout streams interfere to each other, whereby the blowing effect can be improved without extremely increasing the outer diameter of the lance to establish the increase of the cooling ability and the improvement of the combustibility, and hence the specific consumption of the reducing material can be decreased.

By using the tube-bundle type lance prepared by arranging the spiral blowing tube for the gaseous reducing material and the spiral blowing tube for the combustible gas around the cylindrical blowing tube for the solid reducing material (pulverized coal) passing through the central portion and integrally uniting them are flown the LNG (gaseous reducing material) stream and oxygen (combustible gas) stream in a state of revolving around the pulverized coal (solid reducing material) stream, whereby the pulverized coal (solid reducing material) can be blown diffusely to more further improve the combustion rate of the pulverized coal (solid reducing material).

Although the aforementioned embodiment is explained by using LNG as a gaseous reducing material, it is possible to use a town gas. In addition to the town gas and LNG, propane gas, hydrogen as well as converter gas, blast furnace gas and coke-oven gas produced in the ironworks can be used as the other gaseous reducing material. Moreover, shale gas may be utilized in equivalence to LNG. The shale gas is a natural gas obtained from a shale stratum, which is called as a non-conventional natural gas resource because it is produced in a place different from the conventional gas field.

DESCRIPTION OF REFERENCE SYMBOLS

1: blast furnace, 2: blowpipe, 3: tuyere, 4: lance, 5: raceway, 6: pulverized coal (solid reducing material), 7: clumpy coke, 8: char, 9: LNG (gaseous reducing material), 21: first tube, 22: second tube, 23: third tube

The invention claimed is:

1. A method of operating a blast furnace by blowing at least a solid reducing material and a combustible gas into the furnace through tuyeres with a lance inserted into a blowpipe, wherein a tube-bundle lance obtained by bundling a plurality of blowing tubes is used and when only a solid reducing material or two kinds of a solid reducing material and a combustible gas or three kinds of a solid reducing material, a combustible gas and a gaseous reducing material is simultaneously blown into an inside of the blast furnace as blowout streams through a tube for blowing the solid reducing material, a tube for blowing the combustible gas and a tube for blowing the gaseous reducing material in the tube-bundle lance, two or more tube-bundle lances are inserted into the blowpipe to approximate their front ends to each other and blowing is performed so that the respective blowout streams interfere with each other in the blowpipe.

2. The method of operating a blast furnace according to claim 1, wherein the tube-bundle lance is constructed by bundling three parallel blowing tubes and housing them into an outer tube of the lance.

3. The method of operating a blast furnace according to claim 1, wherein the tube-bundle lance is constructed by passing a tube for blowing the solid reducing material through a central portion of the lance and alternately winding both of a spiral tube for blowing the combustible gas and a spiral tube for blowing the gaseous reducing material around the solid reducing material blowing tube to integrally unite them.

4. The method of operating a blast furnace according to claim 1, wherein when at least solid reducing material and combustible gas are simultaneously blown through the respective tubes of the two tube-bundle lances, a blowing stream of the solid reducing material is flown outside a blowing stream of the combustible gas passing through a central portion of the blowpipe.

5. The method of operating a blast furnace according to claim 1, wherein when at least solid reducing material and combustible gas are simultaneously blown through the respective lances of the two tube-bundle lances, blowing is performed by arranging the lances so that two blowing streams of the solid reducing material blown from the respective tube-bundle lances do not collide with each other, while the blowing streams of the solid reducing material collide with a blowing stream of the combustible gas.

6. The method of operating a blast furnace according to claim 1, wherein when at least solid reducing material and combustible gas are simultaneously blown through the respective lances of the two tube-bundle lances, the blowing streams of the solid reducing material blown from the respective tube-bundle lances do not collide with each other, while they converge and collide with blowing streams of the combustible gas blown from the respective tube-bundle lances to thereby separate the two blowing streams of the solid reducing material.

7. The method of operating a blast furnace according to claim 1, wherein when at least solid reducing material and combustible gas are simultaneously blown through the respective lances of the two tube-bundle lances, blowing streams of the solid reducing material blown from the respective tube-bundle lances collide with each other, while blowing streams of the gaseous reducing material and the combustible gas not converging nor colliding with the blowing stream of the solid reducing material are blown so as to introduce into the outside of the blowing stream of the solid reducing material in the central portion of the blowpipe.

8. The method of operating a blast furnace according to claim 2, wherein when at least solid reducing material and combustible gas are simultaneously blown through the respective tubes of the two tube-bundle lances, a blowing stream of the solid reducing material is flown outside a blowing stream of the combustible gas passing through a central portion of the blowpipe.

9. The method of operating a blast furnace according to claim 2, wherein when at least solid reducing material and combustible gas are simultaneously blown through the respective lances of the two tube-bundle lances, blowing is performed by arranging the lances so that two blowing streams of the solid reducing material blown from the respective tube-bundle lances do not collide with each other, while the blowing streams of the solid reducing material collide with a blowing stream of the combustible gas.

10. The method of operating a blast furnace according to claim 2, wherein when at least solid reducing material and combustible gas are simultaneously blown through the respective lances of the two tube-bundle lances, the blowing streams of the solid reducing material blown from the respective tube-bundle lances do not collide with each other, while they converge and collide with blowing streams of the combustible gas blown from the respective tube-bundle lances to thereby separate the two blowing streams of the solid reducing material.

11. The method of operating a blast furnace according to claim 2, wherein when at least solid reducing material and combustible gas are simultaneously blown through the respective lances of the two tube-bundle lances, blowing streams of the solid reducing material blown from the respective tube-bundle lances collide with each other, while blowing streams of the gaseous reducing material and the combustible gas not converging nor colliding with the blowing stream of the solid reducing material are blown so as to introduce into the outside of the blowing stream of the solid reducing material in the central portion of the blow-pipe.

* * * * *